United States Patent [19]

Senn

[11] 4,261,252

[45] * Apr. 14, 1981

[54] PIERCING STRUCTURE

[76] Inventor: Charles Senn, 12633 Wilfred, Detroit, Mich. 48213

[ * ] Notice: The portion of the term of this patent subsequent to Feb. 6, 1996, has been disclaimed.

[21] Appl. No.: 914,495

[22] Filed: Jun. 12, 1978

[51] Int. Cl.[3] ..... F01B 15/02

[52] U.S. Cl. ..... 92/117 R; 92/151; 92/165 PR; 91/207

[58] Field of Search ..... 91/207, 208, 209, 411 A; 92/152, 151, 117 R

[56] References Cited

U.S. PATENT DOCUMENTS

| | | | |
|---|---|---|---|
| 2,841,117 | 7/1958 | Senn | 92/107 |
| 2,982,257 | 5/1961 | Fagge | 92/151 |
| 3,430,539 | 3/1969 | Freeman | 91/411 A |
| 3,477,345 | 11/1969 | Johnson | 91/207 |
| 3,752,040 | 8/1973 | Pawloski | 91/411 A |
| 4,137,828 | 2/1979 | Senn | 91/207 |

FOREIGN PATENT DOCUMENTS

| | | | |
|---|---|---|---|
| 455964 | 12/1950 | Italy | 91/207 |
| 185998 | 3/1967 | U.S.S.R. | 91/207 |

*Primary Examiner*—Paul E. Maslousky

*Attorney, Agent, or Firm*—Whittemore, Hulbert & Belknap

[57] ABSTRACT

Triple action piercing structure comprising an outer cylinder, an inner cylinder, a shaft and radially extending piston means operable between the inner and outer cylinders for providing a plurality of separate pressure chambers between the inner and outer cylinders, specific, simple and efficient passage means for passing a pressure medium into and exhausting the pressure medium from the pressure chambers to produce relative axial movement between the inner and outer cylinders at a particularly high pressure for cylinders of predetermined diameter to facilitate piercing of large diameter openings in thick hard workpieces.

7 Claims, 4 Drawing Figures

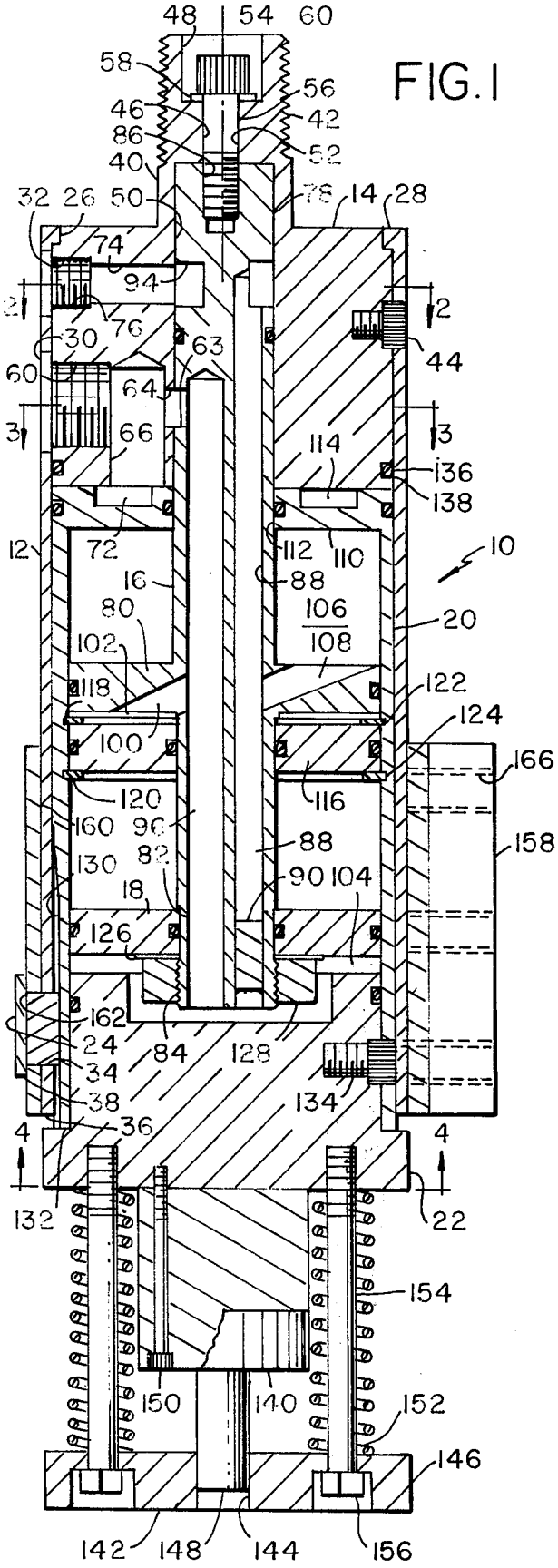
FIG. 1
FIG. 2
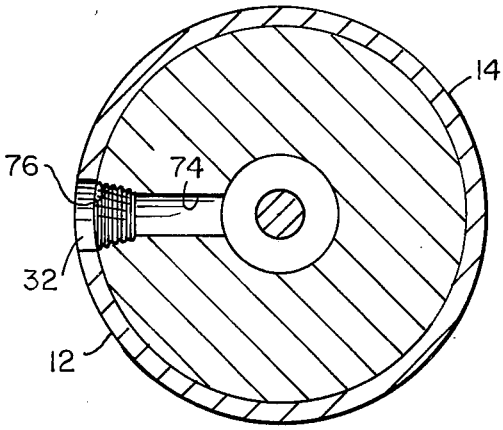
FIG. 3
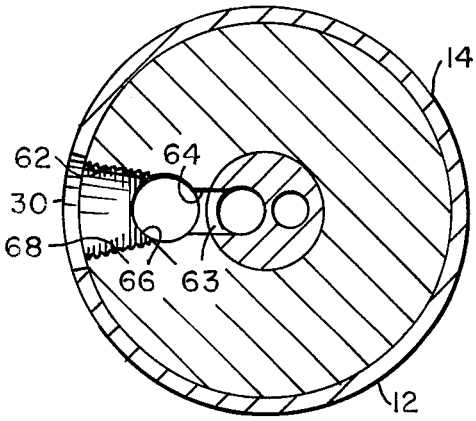
FIG. 4
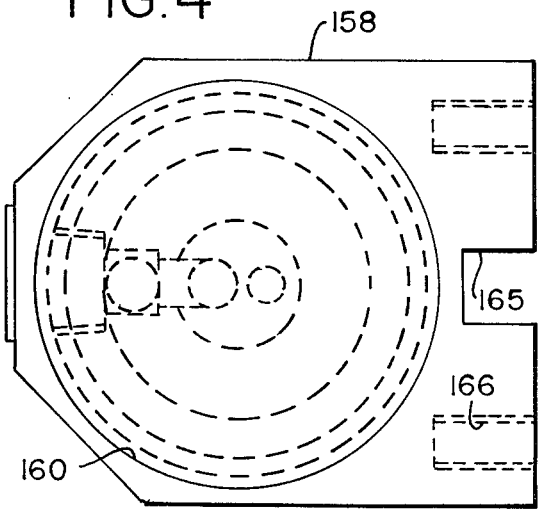

PIERCING STRUCTURE

BACKGROUND OF THE INVENTION

1. Field of the Invention

The invention relates to piercing structures and refers more particularly to a piercing structure of relatively small diameter capable of exerting extremely high pressures due to a plurality of separate axially spaced apart and aligned pressure chambers therein, whereby particularly heavy workpieces may be readily pierced at relatively close intervals of spacing.

2. Description of the Prior Art

The piercing structure of the invention is similar to the piercing structure disclosed in U.S. Pat. No. 2,841,117. The piercing structure of the invention is an improvement over prior piercing structures in that, for example, three separate axially aligned pressure chambers are provided in the piercing structure of the present invention which increases the available pressure in the piercing structure for a given diameter.

With the piercing structure of the current design, it is thus possible to provide increased pressure necessary to pierce large diameter openings in thick hard metal plates.

SUMMARY OF THE INVENTION

In accordance with the present invention, a piercing structure is provided including an outer cylinder having an end cap in one end thereof and including an axis of generation, a shaft having one end secured to the end cap of the outer cylinder on the center of the axis of generation of the outer cylinder and including a radially extending piston portion centrally thereof, and an annular, radially extending piston member secured to the other end thereof, an inner cylinder having a radially extending end portion at one end thereof, an end cap secured thereto at the other end thereof, and an annular piston member rigidly secured within the inner cylinder centrally thereof between the piston portion of the shaft and the piston member on the other end of the shaft whereby four separate, axially spaced apart and axially aligned pressure chambers are provided acting between the outer cylinder and inner cylinder on actuation of the piercing structure.

The piercing structure further includes specific, simple, and efficient means for introducing a pressure transferring medium into three of the pressure chambers simultaneously or withdrawing the pressure medium from the three pressure chambers, and for introducing into or withdrawing a pressure medium out of a fourth pressure chamber provided between the radially extending end portion of the inner cylinder and the piston portion of the shaft, whereby the inner cylindrical member may be axially reciprocated relative to the outer cylindrical member.

The piercing structure of the present invention further includes means for securing the outer cylinder of the piercing structure to structure for moving the entire piercing structure axially or holding the outer cylinder stationary, means for preventing relative rotation between the inner and outer cylinders, and means for securing a piercing tool and stripping structure to the other end of the inner cylinder.

BRIEF DESCRIPTION OF THE DRAWINGS

FIG. 1 is a longitudinal section view of piercing structure constructed in accordance with the invention, taken substantially on the line 1—1 in FIG. 2.

FIG. 2 is a cross section of the piercing structure illustrated in FIG. 1, taken substantially on the line 2—2 in FIG. 1.

FIG. 3 is a cross section of the piercing structure illustrated in FIG. 1, taken substantially on the line 3—3 in FIG. 1.

FIG. 4 is a cross section of the piercing structure illustrated in FIG. 1, taken substantially on the line 4—4 in FIG. 1.

DESCRIPTION OF THE PREFERRED EMBODIMENT

As shown best in FIG. 1, the piercing structure 10 includes an outer cylinder 12 having an end cap 14 secured thereto, a shaft 16, one end of which is secured in the end cap 14, having a piston member 18 secured to the other end thereof, and an inner cylinder 20, having one end secured within the outer cylinder 12 and including an end cap 22 secured in the other end thereof. Slot and key means 24 are operable between the outer and inner cylinders 12 and 20 to prevent relative rotation therebetween while allowing relative axial movement. A piercing tool 140 and stripping means 142 are secured to the end cap 22 as shown in FIG. 1.

More specifically, the outer cylinder 12 is provided with a short radially extending flange 26 at the one end 28 thereof which provides a seat for the end cap 14. Openings 30 and 32 extend through the outer cylinder 12 adjacent the one end 28 thereof through which a pressure transfer medium such as air is passed into and out of the piercing structure. An additional opening 34 extends radially through the other end 36 of the outer cylinder 12 for receiving the key 38 of the key and slot means 24, as will be considered subsequently.

The end cap 14 is cylindrical and as shown has a reduced diameter end 40 including a threaded portion 42 thereon by which the piercing structure 10 may be secured to an appropriate fixture in position to perform a piercing operation on reciprocation of the inner cylinder 20 with respect to the outer cylinder 12. The outer cylinder 12 is secured to the end cap 14 by convenient means such as screws 44. A passage 46 having the larger diameter portions 48 and 50, with the smaller diameter portion 52 therebetween, extends through the end cap 14 on the axis of generation 54 of the outer cylinder 12. As shown, the central portion 52 of the passage 46 receives the body of the bolt 56 which secures the shaft 16 to the end cap 14, while the one end portion 48 of the passage 46 receives the washer 58 and head 60 of the bolt 56, and the portion 50 of the passage 46 receives the end 78 of shaft 16 secured therein by the bolt 56.

A first passage 62 having a radially extending portion 64 and an axially extending portion 66 extends through the end cap 14, as shown best in FIGS. 1 and 3. One end 68 of the radially extending portion of the passage 62 is threaded and is aligned with the opening 30 in the outer cylinder 12, whereby a pressure medium conduit may be connected to the end cap 14 to pass pressure transfer medium through the passage 62.

A second radially extending passage 74 having a threaded outer end portion 76 aligned with the opening 32 through the outer cylinder 12 extends through the end cap 14 as shown best in FIG. 2. Pressure transfer medium is also passed through the passage 74 from a pressure conduit not shown.

The shaft 16, as shown, has an end 78 extending into the portion 50 of the passage 46 in the end cap 14 and is held in position in the passage 46 by means of the bolt 56. The shaft 16 includes a centrally positioned, radially extending piston portion 80 thereon extending from the outer diameter of the shaft to the inner diameter of the inner cylinder.

In addition, the shaft 16 has a reduced diameter end portion 82 for receiving the annular piston member 18 and has a threaded other end 84.

A first passage 86 extends centrally of the one end 78 of the shaft 16 on the center of generation of the outer cylinder 12. A second passage 88 extends through the other end 84 of the shaft 16, and as shown best in FIG. 1, the second passage 88 stops short of passage 86. An end plug 90 is provided in the passage 88.

An annular groove 94 is provided adjacent the end 78 of the shaft 16 and is in communication with the passage 88. The annular groove 94 is also in communication with the radially inner end of the passage 74 through the end cap 14.

The passage 88 is in communication with the return pressure chamber 106 through the radially extending passage 108, as shown.

A further axial passage 96 is provided in the shaft 16 from the end 84 thereof, which passage 96 is in communication with the portion 64 of passage 62 through radial passage 63, as shown best in FIG. 1. A radially extending passage 100 is in communication with the passage 96 so that the passage 96 is in communication with the pressure chamber 102. The passage 96 is also in communication with the pressure chamber 104 through the end 84 of the shaft 16.

Inner cylinder 20 has a radially extending end portion 110 including the opening 112 for the shaft 16 therein. The cylinder portion 110 includes an annular portion 114, which provides an initial actuating pressure chamber 72 with the cylinder 20 retracted, as shown in FIG. 1.

The annular member 116 is secured within the inner cylinder 20 centrally thereof, as shown, by means of the retaining rings 118 and 120 on opposite sides thereof extending within the grooves 122 and 124 in the inner cylinder 20.

As previously indicated, the annular piston member 18 is secured over the reduced diameter portion 82 of shaft 16 by means of washer 126 and nut 128.

Slot 130 is provided in the outer surface of the cylinder 20, as shown best in FIG. 1, and cooperates with the key 38 to prevent relative rotation between the outer cylinder 12 and the inner cylinder 20.

End plate 22, having a cross section as shown best in FIG. 1, is secured over the end 132 of the inner cylinder 20 by convenient means such as bolts 134.

Annular sealing rings 136 are provided in annular grooves in the piercing structure as shown.

As shown best in FIG. 1, a cylindrical piercing tool 140 having a reduced diameter end portion 148 is secured to end cap 22 by convenient means such as bolts 150.

The stripping structure 142 includes the stripping plate 146 having openings 144 and 152 extending therethrough. Plate 146 is fitted over the reduced diameter end 148 of the stripping tool 140 with the tool 140 in opening 144. Plate 146 is held in position on end cap 22 by means of bolts 154 extending loosely through openings 152 and into end cap 22. Springs 154 are sleeved over bolts 154 and operate between end cap 22 and plate 146 to bias the plate 146 into engagement with the heads 156 on bolts 154.

A collar 158 having a cylindrical opening 160 therethrough surrounds the outer cylinder 12 adjacent the lower end thereof and is secured to cylinder 12 by convenient means such as welding. Collar 158 has opening 162 extending radially therethrough through which key 24 extends. Collar 158 includes aligning slot 165 therein and is adapted to be secured to a positioning ram or the like by bolts (not shown) extending into threaded openings 166 in the collar 158.

In operation of the piercing structure 10, the structure is first secured in a fixed position by means of collar structure 160 and/or the threads 42 on the end cap 14. A pressure transfer medium such as air is connected through the opening 30 in the outer cylinder 12 into the passage 62. A pressure transfer medium is also connected through the opening 32 into the passage 74. The pressure transfer medium may be passed to the piercing structure 10 through suitable hoses and connectors, not part of the invention and therefore not illustrated.

With the piercing tool 140 connected to end cap 22, the pressure transfer medium is passed into the passage 96 by known valve means, not shown. The actuating pressure may, for example, be 80 pounds per square inch and will be felt in the actuating pressure chambers 72, 102 and 104 at the same time. The actuating pressure will cause the inner cylinder 20 to move down in FIG. 1, out of the end 36 of the outer cylinder 12 to move the piercing tool 140 connected to the end plate 22 toward a workpiece to be pierced through opening 144 in stripping plate 146.

After the initial movement, the outer diameter of the chamber 72 will be the inner diameter of the outer cylinder 12. The outer diameter of the chamber 102 and the outer diameter of the chamber 104 will be the inner diameter of the inner cylinder 20. The inner diameter of the chambers 70 and 102 will be the outer diameter of the shaft 16. The chamber 104 will have no inner diameter.

Thus, with a four inch outer diameter of outer cylinder 12, the areas of chambers 70, 102 and 104 in a preferred embodiment may be 10.26 sq. in., 8.16 sq. in. and 8.94 sq. in., respectively. The total pressure area for an actuating stroke will thus be 27.26 sq. in., whereby with an 80-pound line pressure piercing could be performed at 2181 pounds pressure. With a 100-pound line pressure piercing could be performed with 2726 pounds pressure. Such pressures are not presently available in piercing structure having such small diameter utilizing similar line pressures and are essential in piercing thick metal and metal having a high shear strength.

The stroke of the piercing structure may, for example, be one inch.

After piercing is completed, the pressure medium is exhausted from the pressure chamber 70, 102 and 104 and pressure medium is applied through the passage 74 into the retraction pressure chamber 106 which may, for example, have an area of 8.16 sq. in. to provide a return stroke for the piercing structure 10. It will be readily understood that the pressure required for the return stroke is not as great as that required for the actuating stroke since no piercing is performed with the inner cylinder 20 retracted as shown in FIG. 1.

The workpiece is stripped from the piercing tool 140 on the return stroke by springs 148 of the stripping structure 142 acting on the plate 146. The plate 146 bears on the workpiece under bias of the springs 148.

While one embodiment of the triple acting piercing structure of the invention has been disclosed in detail, it will be understood that other modifications and embodiments are contemplated. It is the intention to include all embodiments and modifications of the invention as are defined by the appended claims within the scope of the invention.

What I claim as my invention is:

1. Piercing structure comprising an outer cylinder having an axis of generation, an end cap secured within one end of the outer cylinder, said end cap having a dual diameter axially extending bore therein with the larger diameter opening toward the other end of the outer cylinder and a shank portion extending out of the one end of the outer cylinder on the axis thereof including a threaded end thereon, a shaft extending axially of the outer cylinder one end of which extends into the larger diameter end of the dual diameter axially extending bore through the end cap in the outer cylinder, a bolt extending through the smaller diameter portion of the dual diameter axially extending bore through the end cap in the outer cylinder threadedly engaging the one end of the shaft to secure the one end of the shaft in the bore in the end cap in the one end of the outer cylinder, a radially extending piston portion constructed integrally with said shaft substantially centrally thereof, said shaft having a reduced diameter other end portion forming an abutment and a threaded outer end, a single member inner cylinder positioned within the outer cylinder for reciprocal axial movement relative thereto having an integral radially extending annular inner end piston portion extending radially between the inner surface of the outer cylinder and the outer surface of the shaft, said integral piston portion being positioned between the end cap in the one end of the outer cylinder and the integral piston portion on the shaft and forming a first piercing structure extension pressure chamber between the end cap in the outer cylinder and the integral piston portion on the inner cylinder in conjunction with the shaft and outer cylinder, said integral piston portion of said inner cylinder and the integral piston portion of said shaft forming a sole piercing structure retraction pressure chamber therebetween in conjunction with the shaft and inner cylinder, an annular piston member sleeved over said shaft and secured to the inner surface of the inner cylinder on the side of the integral piston portion of the shaft opposite the integral piston portion of the inner cylinder by means including annular grooves in the inner surface of the inner cylinder and snap rings positioned therein extending radially into the inner cylinder on each side of the annular piston member sleeved over the shaft, said annular piston member and integral piston portion of the shaft forming a second piercing structure extension pressure chamber therebetween in conjunction with the shaft and inner cylinder, an annular piston member sleeved over the reduced diameter other end of the shaft and extending radially to the inner surface of the inner cylinder, nut means secured to the threaded other end of the shaft for securing the annular piston member sleeved over the other end of the shaft between the nut and abutment formed by the reduced diameter end of the shaft, an end cap secured in the other end of the inner cylinder axially outwardly of the other end of the shaft whereby a third piercing structure extension pressure chamber is formed between the piston member secured to the other end of the shaft and the end cap in the other end of the inner cylinder in conjunction with the shaft and inner cylinder, means for passing a pressure transfer medium into and out of the piercing structure extension pressure chambers, means for passing a pressure transfer medium into and out of the piercing structure retraction sole pressure chamber, and piercing means secured to the end cap in the other end of the inner cylinder on the surface thereof opposite the annular piston secured to the other end of the shaft.

2. Structure as set forth in claim 1, wherein the means for passing a pressure transfer medium into and out of the piercing structure extension pressure chambers comprises a transverse opening adjacent the one end of the outer cylinder, a radially extending bore in the end cap in the one end of the outer cylinder aligned with the opening adjacent the inner end of the outer cylinder, an axially extending passage in the end cap in the outer cylinder providing communication between the radially extending passage in the end cap and the first piercing structure extension pressure chamber, a radially and axially extending first passage in the shaft extending from the first piercing structure extension pressure chamber to the other end of the shaft, and a passage in communication with the first passage in the shaft and the second piercing structure extension pressure chamber.

3. Structure as set forth in claim 1, wherein the means for passing a pressure transfer medium into and out of the piercing structure retraction pressure chamber includes a transverse opening adjacent the one end of the outer cylinder, a radially extending passage in the end cap in the outer cylinder between the opening adjacent the one end of the outer cylinder and the dual diameter bore in the end cap, an annular groove in the one end of the shaft in communication with the radially extending passage in the end cap in the outer cylinder, a radially extending bore extending through the one end of the shaft in communication with the annular groove therein, and an axially and radially extending passage in the shaft in communication with the radially extending bore through the one end of the shaft and the piercing structure retraction pressure chamber.

4. Piercing structure comprising an outer cylinder having an axis of generation, an end cap secured within one end of the outer cylinder, said end cap having a dual diameter axially extending bore therein with the larger diameter opening toward the other end of the outer cylinder and a shank portion extending out of the one end of the outer cylinder on the axis thereof including a threaded end thereon, a shaft extending axially of the outer cylinder one end of which extends into the larger diameter end of the dual diameter axially extending bore through the end cap in the outer cylinder, a bolt extending through the smaller diameter portion of the dual diameter axially extending bore through the end cap in the outer cylinder threadedly engaging the one end of the shaft to secure the one end of the shaft in the bore in the end cap in the one end of the outer cylinder, a radially extending piston portion constructed integrally with said shaft substantially centrally thereof, said shaft having a reduced diameter other end portion forming an abutment and a threaded outer end, a single member inner cylinder positioned within the outer cylinder for reciprocal axial movement relative thereto having an integral radially extending annular inner end piston portion extending radially between the inner surface of the outer cylinder and the outer surface of the shaft, said integral piston portion being positioned between the end cap in the one end of the outer cylinder and the integral piston portion on the shaft and forming a first piercing structure extension pressure chamber between the end cap in the outer cylinder and the integral piston portion on the inner cylinder in conjunction with the shaft and outer cylinder, said integral piston portion of said inner cylinder and the integral piston portion of said shaft forming a sole piercing structure retraction pressure chamber therebetween in conjunction with the shaft and inner cylinder, an annular piston member sleeved over said shaft and secured to the inner surface of the inner cylinder on the side of the integral piston portion of the shaft opposite the integral piston portion of the inner cylinder by means including annular grooves in the inner surface of the inner cylinder and snap rings positioned therein extending radially into the inner cylinder on each side of the annular piston member sleeved over the shaft, said annular piston member and integral piston portion of the shaft forming a second piercing structure extension pressure chamber therebetween in conjunction with the shaft and inner cylinder, an annular piston member sleeved over the reduced diameter other end of the shaft and extending radially to the inner surface of the inner cylinder, nut means secured to the threaded other end of the shaft for securing the annular piston member sleeved over the other end of the shaft between the nut and abutment formed by the reduced diameter end of the shaft, an end cap secured in the other end of the inner cylinder axially outwardly of the other end of the shaft whereby a third piercing structure extension pressure chamber is formed between the piston member secured to the other end of the shaft and the end cap in the other end of the inner cylinder in conjunction with the shaft and inner cylinder, means for passing a pressure transfer medium into and out of the piercing structure extension pressure chambers comprising a first transverse opening adjacent the one end of the outer cylinder, a first radially extending bore in the end cap in the one end of the outer cylinder aligned with the opening adjacent the inner end of the outer cylinder, a first axially extending passage in the end cap in the outer cylinder providing communication between the first radially extending passage in the end cap and the first piercing structure extension pressure chamber, a first radially and axially extending passage in the shaft extending from the first actuating pressure chamber to the other end of the shaft, and a passage in communication with the first passage in the shaft and the second piercing structure extension pressure chamber, means for passing a pressure transfer medium into and out of the piercing structure retraction pressure chamber operably associated with the inner and outer cylinders including a second transverse opening adjacent the one end of the outer cylinder, a second radially extending passage in the end cap in the outer cylinder between the second opening adjacent the one end of the outer cylinder and the dual diameter bore in the end cap, an annular groove in the one end of the shaft in communication with the second radially extending passage in the end cap in the outer cylinder, a radially extending bore extending through the one end of the shaft in communication with the annular groove therein, and a second axially and radially extending passage in the shaft in communication with the radially extending bore through the one end of the shaft and the piercing structure retraction pressure chamber, and piercing means comprising a piercing tool, means securing the piercing tool to the end cap in the other end of the inner cylinder and stripping structure including a plate having an opening therethrough through which the stripping tool is adapted to extend, bolts extending through the plate on opposite sides of the opening through which the stripping tool is adapted to extend, which bolts are secured in the end cap in the other end of the inner cylinder and resilient means operable between the end cap in the other end of the inner cylinder and plate for urging the plate away from the end cap in the other end of the inner cylinder.

5. Piercing structure comprising an outer cylinder having an axis of generation, an end cap secured in one end of the outer cylinder, a shaft, means for securing the shaft to the center of the end cap within the outer cylinder at one end thereof with the shaft extending along the axis of generation of the outer cylinder including a threaded shank integral with the end cap in the one end of the outer cylinder having a dual diameter bore extending axially therethrough with the larger diameter opening toward the other end of the outer cylinder, the one end of the shaft extending into the larger diameter portion of the dual diameter bore and a bolt extending through the smaller diameter end of the dual diameter bore and threadedly engaging the one end of the shaft to secure the shaft in the end cap in the outer cylinder, a single member inner cylinder having a radially extending piston portion at one end thereof with an axially extending hole therethrough for receiving the shaft which is positioned within the outer cylinder over the shaft for reciprocal movement relative to the outer cylinder along the axis of generation thereof, whereby a first piercing structure extension pressure chamber is formed between the radially extending piston portion of the inner cylinder and the end cap in the one end of the outer cylinder in conjunction with the outer cylinder, a piston secured to the shaft centrally thereof on the side the piston portion of the inner cylinder opposite the end cap in the outer cylinder and extending radially from the shaft to the inner wall of the inner cylinder forming a piercing structure retracting pressure chamber between the adjacent surface of the radially extending piston portion of the inner cylinder and one surface of the piston secured to the shaft, a radially extending annular piston rigidly secured to the inner cylinder substantially centrally thereof through which the shaft extends, whereby a second piercing structure extension pressure chamber is formed between the other surface of the piston member secured to the shaft and one surface of the piston secured to the inner cylinder in conjunction with the shaft and the inner cylinder, an annular piston secured to the other end of the shaft on the side of the annular piston secured to the inner cylinder opposite the piston secured to the shaft centrally thereof, an end cap positioned in the other end of the inner cylinder on the side of the piston secured to the other end of the shaft opposite the piston secured to the inner cylinder, whereby a third piercing structure extension pressure chamber is formed between the annular piston secured to the other end of the shaft and the end cap in the other end of the inner cylinder in conjuncton with the shaft and the inner cylinder, means for passing a pressure transfer medium into and out of the piercing structure extension pressure chambers simultaneously, means for passing a pressure transfer medium into and out of the piercing structure retraction pressure chamber, and piercing means secured to the end cap in the other end of the inner cylinder on the surface thereof opposite the annular piston secured to the other end of the shaft.

6. Piercing structure comprising an outer cylinder having an axis of generation, an end cap secured in one end of the outer cylinder, a shaft, means for securing the shaft to the center of the end cap within the outer cylinder at one end thereof with the shaft extending along the axis of generation of the outer cylinder, a single member inner cylinder having a radially extending piston portion at one end thereof with an axially extending hole therethrough for receiving the shaft which is positioned within the outer cylinder over the shaft for reciprocal movement relative to the outer cylinder along the axis of generation thereof, whereby a first piercing structure extension pressure chamber is formed between the radially extending piston portion of the inner cylinder and the end cap in the one end of the outer cylinder in conjunction with the outer cylinder, a piston secured to the shaft centrally thereof on the side of the piston portion of the inner cylinder opposite the end cap in the outer cylinder and extending radially from the shaft to the inner wall of the inner cylinder forming a piercing structure retracting pressure chamber between the adjacent surface of the radially extending piston portion of the inner cylinder and one surface of the piston secured to the shaft, a radially extending annular piston rigidly secured to the inner cylinder substantially centrally thereof through which the shaft extends, whereby a second piercing structure extension pressure chamber is formed between the other surface of the piston member secured to the shaft and one surface of the piston secured to the inner cylinder in conjunction with the shaft and the inner cylinder, an annular piston secured to the other end of the shaft on the side of the annular piston secured to the inner cylinder opposite the piston secured to the shaft centrally thereof, an end cap positioned in the other end of the inner cylinder on the side of the piston secured to the other end of the shaft opposite the piston secured to the inner cylinder, whereby a third piercing structure extension pressure chamber is formed between the annular piston secured to the other end of the shaft and the end cap in the other end of the inner cylinder in conjunction with the shaft and the inner cylinder, means for passing a pressure transfer medium into and out of the piercing structure extension pressure chambers simultaneously, means for passing a pressure transfer medium into and out of the piercing structure retraction pressure chamber, piercing means secured to the end cap in the other end of the inner cylinder on the surface thereof opposite the annular piston secured to the other end of the shaft and further including an axially extending slot in the other end of the outer cylinder, an axially extending elongated groove in the other end of the inner cylinder aligned with the slot, and key means secured to the outer cylinder passing through the slot therein and extending into the groove in the inner cylinder for preventing relative rotation of the inner cylinder within the outer cylinder.

7. Piercing structure comprising an outer cylinder having an axis of generation, an end cap secured in one end of the outer cylinder, a shaft, means for securing the shaft to the center of the end cap within the outer cylinder at one end thereof with the shaft extending along the axis of generation of the outer cylinder, a single member inner cylinder having a radially extending piston portion at one end thereof with an axially extending hole therethrough for receiving the shaft which is positioned within the outer cylinder over the shaft for reciprocal movement relative to the outer cylinder along the axis of generation thereof, whereby a first piercing structure extension pressure chamber is formed between the radially extending piston portion of the inner cylinder and the end cap in the one end of the outer cylinder in conjunction with the outer cylinder, a piston secured to the shaft centrally thereof on the side of the piston portion of the inner cylinder opposite the end cap in the outer cylinder and extending radially from the shaft to the inner wall of the inner cylinder forming a piercing structure retracting pressure chamber between the adjacent surface of the radially extending piston portion of the inner cylinder and one surface of the piston secured to the shaft, a radially extending annular piston through which the shaft extends, means for rigidly securing the radially extending annular piston to the inner cylinder substantially centrally thereof comprising a pair of annular spaced apart grooves on the inner surface of the inner cylinder, and snap rings positioned partly within the grooves and extending partly into the inner cylinder on either side of the radially extending annular piston whereby a second piercing structure extension pressure chamber is formed between the other surface of the piston member secured to the shaft and one surface of the piston secured to the inner cylinder in conjunction with the shaft and the inner cylinder, an annular piston secured to the other end of the shaft on the side of the annular piston secured to the inner cylinder opposite the piston secured to the shaft centrally thereof, an end cap positioned in the other end of the inner cylinder on the side of the piston secured to the other end of the shaft opposite the piston secured to the inner cylinder, whereby a third piercing structure extension pressure chamber is formed between the annular piston secured to the other end of the shaft and the end cap in the other end of the inner cylinder in conjunction with the shaft and the inner cylinder, means for passing a pressure transfer medium into and out of the piercing structure extension pressure chambers simultaneously, means for passing a pressure transfer medium into and out of the piercing structure retraction pressure chamber, and piercing means secured to the end cap in the other end of the inner cylinder on the surface thereof opposite the annular piston secured to the other end of the shaft.

* * * * *